US006443247B1

(12) United States Patent
Wardley

(10) Patent No.: US 6,443,247 B1
(45) Date of Patent: Sep. 3, 2002

(54) CASING DRILLING SHOE

(75) Inventor: Michael Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/719,317

(22) PCT Filed: Jun. 9, 1999

(86) PCT No.: PCT/GB99/01816

§ 371 (c)(1),
(2), (4) Date: Feb. 20, 2001

(87) PCT Pub. No.: WO99/64713

PCT Pub. Date: Dec. 16, 1999

(30) Foreign Application Priority Data

Jun. 11, 1998 (GB) ..... 9812554
Jul. 7, 1998 (GB) ..... 9814597

(51) Int. Cl.[7] ..... E21B 17/14
(52) U.S. Cl. ..... 175/402; 175/268; 175/270; 166/242.8
(58) Field of Search ..... 175/402, 268, 175/270; 166/242.8, 327, 328

(56) References Cited

U.S. PATENT DOCUMENTS 2,334,788 A * 11/1943 O'Leary ..... 175/267
2,940,731 A 6/1960 Poole
5,127,482 A 7/1992 Rector
6,062,326 A * 5/2000 Strong et al. ..... 175/402

FOREIGN PATENT DOCUMENTS

GB 2170528 A 8/1986
WO WO 96 28635 A 9/1996

* cited by examiner

*Primary Examiner*—David Bagnell
*Assistant Examiner*—Zakiya Walker
(74) *Attorney, Agent, or Firm*—Clifford W. Browning; Woodard, Emhardt, Naughton, Moriarty & McNett

(57) ABSTRACT

A casing drilling shoe adapted for attachment to a casing string and comprising an outer drilling section constructed of a relatively hard material such as steel and an inner section constructed of a readily drillable material such as aluminum. The drilling shoe further includes a device for controllably displacing the outer drilling section to enable the shoe to be drilled through using a standard drill bit and subsequently penetrated by a reduced diameter casing string or liner.

8 Claims, 3 Drawing Sheets

CASING DRILLING SHOE

The invention has an application particularly, but not exclusively, in relation to the exploration for oil and gas. More specifically, the present invention concerns a casing drilling shoe primarily for use in oil well drilling.

When drilling subterranean formations for the purpose of oil exploration it is normal to firstly drill a section of hole of a particular diameter and then remove the drill bit from the well bore. A tubular member of lesser diameter, known as casing, is placed in the well bore and subsequently the annulus between the drilled hole and the outside of the casing is filled with cement. The purpose of the cement is to isolate certain of the subterranean strata from each other. The next operation is to pass through the casing with a smaller diameter drill bit and drill the further section of hole beyond the previously attained depth. This sequence is repeated as many times as necessary, with smaller and smaller components, until the ultimate desired depth of the well is achieved.

Positioned at the end of each casing string is a rounded guiding component known as a shoe. Typically, the leading edge of the shoe is constructed from cement, to enable it to be easily drilled through by the next drill bit.

The cost of oil exploration particularly in offshore regions is extremely high. For instance, the operating cost of a semi-submersible drill rig is often in excess of $100,000 per day (June 1998). Thus it is in the interest of the operator to minimise the time taken to drill a well. At great depths, the round trip time to pull out a drill bit and replace it with another one can be many hours. This "trip" time is seen as non-productive and wasteful, and a significant advantage can be gained, if, having drilled to target depth the drill bit did not have to be removed from the well bore. In this way, a trip could be saved.

A proposed solution would be to attach the drill bit to the leading end of the casing string and drill to target depth and then cement the casing. Certain advances in recent years have rendered this solution more viable, including the provision of premium casing threads able to take the necessary drilling torque, and rotary top drives able to transmit the torque directly to the trailing end of a drill string are commonplace.

However, technical difficulties have not entirely been overcome and this is clearly evidenced by the fact that the industry has not adopted "drilling with casing" to date.

One major remaining issue concerns the drill bit itself. By design drill bits are robust devices able to withstand the rigours of a downhole environment. They are generally made from hard materials such as steel or tungsten carbide matrix. After cementing the drilled-in casing the subsequent drill bit would have to pass through the previous one before exiting the end of the casing string. Unfortunately, modern drill bits optimised for rock removal are unable to drill through the materials from which they themselves are constructed without sustaining a level of damage which would render the task of drilling the next section of rock formation impossible. It is possible to drill through a drill bit with special tools known as mills, but these tools are unable to penetrate rock formations effectively and so the mill would have to be "tripped" from the hole and replaced with a drill bit. In this case, the trip saving advantage gained by drilling with casing would have been lost.

Thus it is recognised in the present invention that considerable advantage is to be gained in the provision of a casing shoe that is able to drill rock formations effectively, but which itself is capable of being drilled by standard oilfield drill bits.

Drilling shoes have been available in the past specifically for attachment to casing, although usually for special applications such as a situation where the lowermost rock strata of a section of a well to be drilled are extremely unconsolidated and there is a consequential risk that after the drill bit is removed from the well the rock strata may collapse into the well bore. This then renders the process of placing the casing in the well bore difficult or impossible. Such casing shoes have invariably been made from the hard materials associated with normal drill bits and as such cannot be drilled through.

Also, casing whilst drilling systems have been and continue to be available to the industry. One such system involves running a casing string and a drill string in tandem. Attached to the leading end of the casing string is a core type bit able to cut a "kerf" of formation. Positioned at the leading end of the drill string is a drill bit driven by a hydraulic motor. Thus, the core bit and the drill bit together can drill a hole of the required diameter. Prior to performing the cementing operation however, the drill bit has to be removed from the well bore and thus the expensive trip is not saved.

Probably the apparatus which comes closest to overcoming the afore-described problems is known as a reamer shoe. Reamer shoes have become available over the last few years and are devices that are able to drill over the extreme outer diameter of the tool but which have an inner section manufactured from a material which is drillable with drill bits. The objective or utility of these tools, however, is to help the casing string enter a difficult well bore and when landed and cemented, pose no obstruction to the subsequent drill bit.

According to the present invention there is provided a casing drilling shoe adapted for attachment to a casing string, wherein the shoe comprises an outer drilling section constructed of a relatively hard material and an inner section constructed of a readily drillable material, and wherein means is provided for controllably displacing the outer drilling section to enable the shoe to be drilled through using a standard drill bit and subsequently penetrated by a reduced diameter casing string or liner.

Optionally, the outer section may be made of steel and the inner section may be made of aluminium.

Preferably, the outer section is provided with one or more blades, wherein the blades are moveable from a first or drilling position to a second or displaced position. Preferably, when the blades are in the first or drilling position they extend in a lateral or radial direction to such extent as to allow for drilling to be performed over the full face of the shoe. This enables the casing shoe to progress beyond the furthest point previously attained in a particular well.

The means for displacing the outer drilling section may comprise of a means for imparting a downward thrust on the inner section sufficient to cause the inner section to move in a down-hole direction relative to the outer drilling section. The means may include an obturating member for obstructing the flow of drilling mud so as to enable increased pressure to be obtained above the inner section, the pressure being adapted to impart the downward thrust.

Typically, the direction of displacement of the outer section has a radial component.

Also according to the invention there is provided a casing drilling shoe adapted for attachment to a casing string, wherein the shoe comprises an outer drilling section constructed of a relatively hard material and an inner section constructed of a readily drillable material, and wherein means is provided for controllably displacing the outer drilling section to a position whereby it does not interfere with subsequent drilling through the shoe for the placement of further casing or a liner down-hole.

An embodiment of the invention will now be described by way of example only and with reference to the accompanying Figures, in which.

Figure 1:
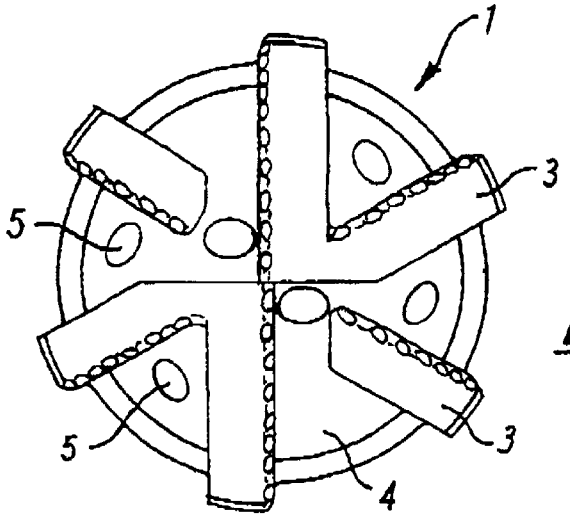
FIG. 1 is an end view of a drill casing shoe or tool in accordance with the invention.
Figure 2:
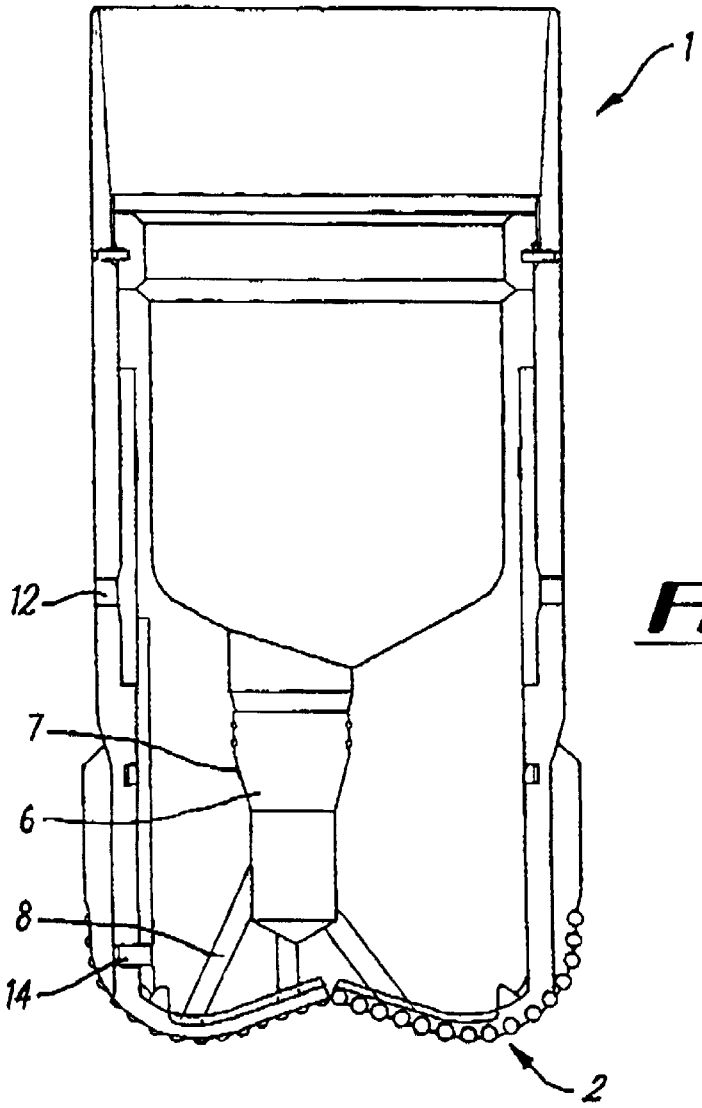
FIG. 2 shows a sectional view in elevation of a tool of FIG. 1 attached to the end of a casing string.

Referring firstly to FIGS. 1 and 2, a drilling shoe is generally depicted at 1. The drilling shoe 1 has an outer drilling section 2 having blades 3. The blades 3 are made of a hard material such as steel which may incorporate a cutting structure of polycrystalline diamond or tungsten carbide for example. They may be of industry standard type and or designed to suit particular formations to be drilled by the tool.

In FIGS. 1 and 2, the outer drilling section 2 is in the drilling mode and, as such, the shoe 1 is incapable of being drilled through by standard drill bits.

The tool 1 is further provided with an inner section 4 which, in the embodiment shown, comprises a generally cylindrical member having ports 5 in its lower region to allow for the passage of drilling mud to the end or drilling face of the tool or shoe 1. The ports 5 communicate via feed passages 8,with a single circular bore 6, the bore 6 providing a circulation path for drilling mud or lubricant. The tool 1 is also provided with an anti-rotation pin 14 to prevent the inner section spinning when being drilled out.

Notably, the bore 6 is adapted to be obstructed or blocked. For example, the bore 6 in the example embodiment includes a ball seat 7 such that upon dropping a bail sized to land on the seat 7, the bore 6 becomes obstructed enabling an operator to pressure-up behind the bore. It will be known to persons skilled in the art that other methods may be employed for this purpose, such as dropping darts and so on.

Figure 3:
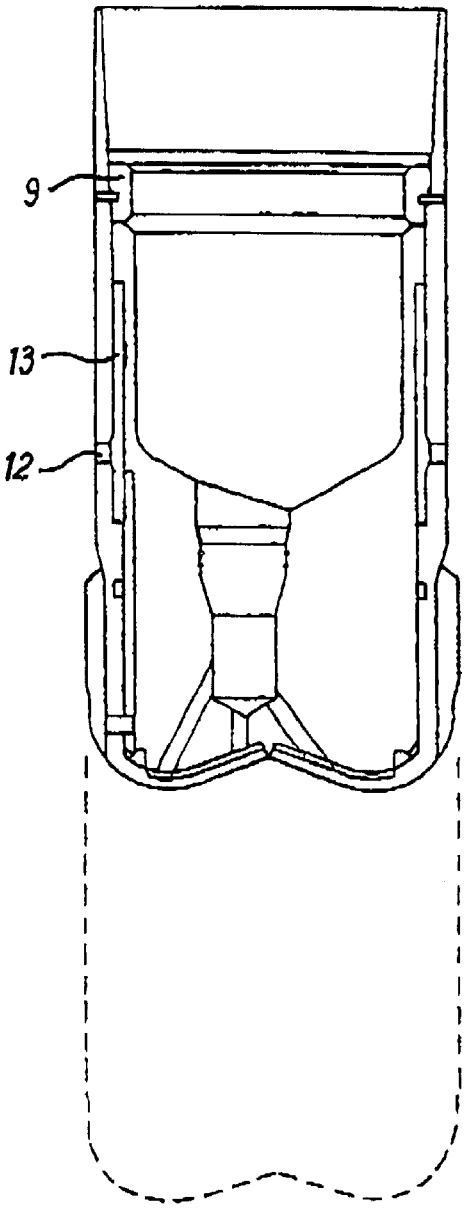
FIG. 3 shows the tool in its normal drilling mode.

As may be seen in FIG. 3, the inner section 4 is captured between the blades 3 of the outer drilling section and, at its upper end, a locking ring 9.

In use, when the tool 1 is in its drilling mode, drilling mud may be pumped down the inside of the casing, through the bore 6 and subsequently through the ports 5 in the inner section 4 The mud, while providing a lubricant, also serves to clean the face of the tool and is able to return up the annulus between the casing and the well bore (not shown). During this process, there would be a small downward thrust on the inner section 4 due to the pressure drop of the mud passing through the ports 5. This thrust would not be sufficient to displace the blades 3 of the outer section 2 relative to the rest of the tool 1.

However, when the drilling process is complete, it is a feature of this invention that the tool or shoe may be manipulated or activated to render it drillable. Activation may be achieved by applying a relatively large downward thrust to the inner portion 4.

Figure 4:
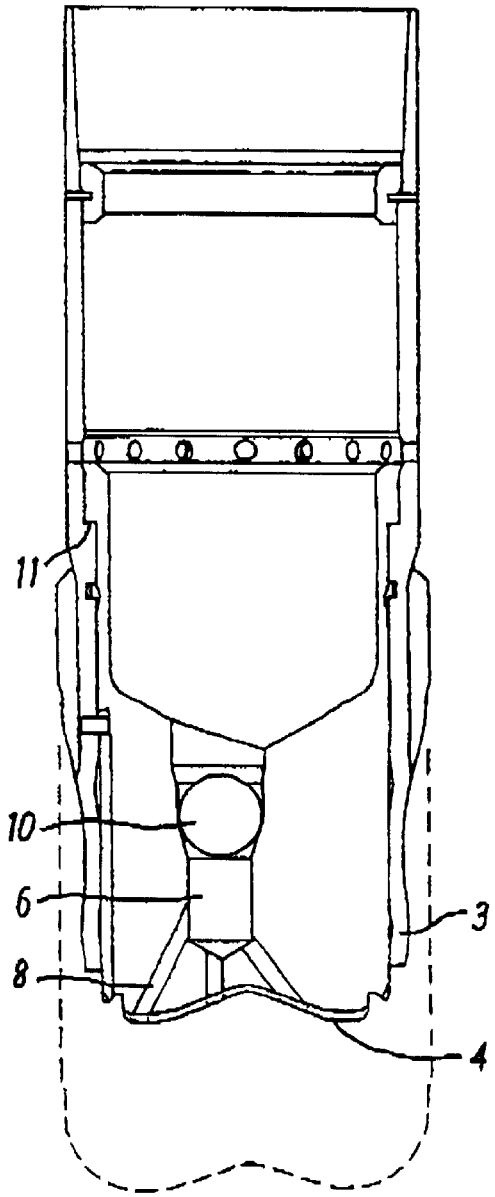
FIGS. 4 and 5 show the tool in respective further stages activated and ready for cementing and subsequent drilling.

In the example embodiment illustrated in the accompanying Figures, the downward thrust results from blocking the bore 6 or flow passages 8 feeding the ports 5 by landing a ball 10 on the seat 7 (see FIG. 4). The ball 10 may be dropped from surface or, preferably, may be released from a remotely actuated mechanism positioned just above the tool 1. Again, methods of achieving remote ball release are known to persons skilled in the art and include, for example, increasing the flow rate of the drilling mud or circulation fluid to a level whereby a support for the ball in its mechanism is overcome. These and other ball release subs are known in the industry.

After the ball 10 is seated, pump pressure rises and the downward thrust load on the inner section 4 increases. This thrust load is transferred to the blades 3 positioned at the leading end of the tool 1. The design of the blades 3 is such that they can be displaced by a predetermined load, well below the maximum safe pressure that the casing can withstand. When this load is reached the blades 3 are displaced outwardly in the manner of downward pointing fingers, while the inner section 4 advances downwardly until its motion is arrested by mating shoulder portions 11 of the inner and outer sections 2,4. In FIG. 4 the inner section 4 has been fully displaced.

It is to be further noted that the outer section 2 is provided with ports 12. In the normal drilling mode, the ports 12 are obstructed by the sleeve 13 as circulation is enabled via the ports 5. However, as may be seen in FIG. 4, the fluid communication ports 12 are caused to open, that is become unobstructed as the sleeve 13 travels down with the inner section 4 under he influence of the downward thrust. This fulfils the necessary requirement of re-establishing circulation at this point, since the cementing operation involves pumping the cement slurry down the inside of the casing and displacing it into the annulus. An added advantage lies in the fact that the operators of the tool are given a clear signal that the tool has activated properly since on opening the ports 12 the pressure level will -Fall significantly.

In FIG. 4, it car be seen that the components that rendered the tool incapable of being drilled have now been displaced to a position where they will not interfere with the next drill bit to be used.

Figure 5:
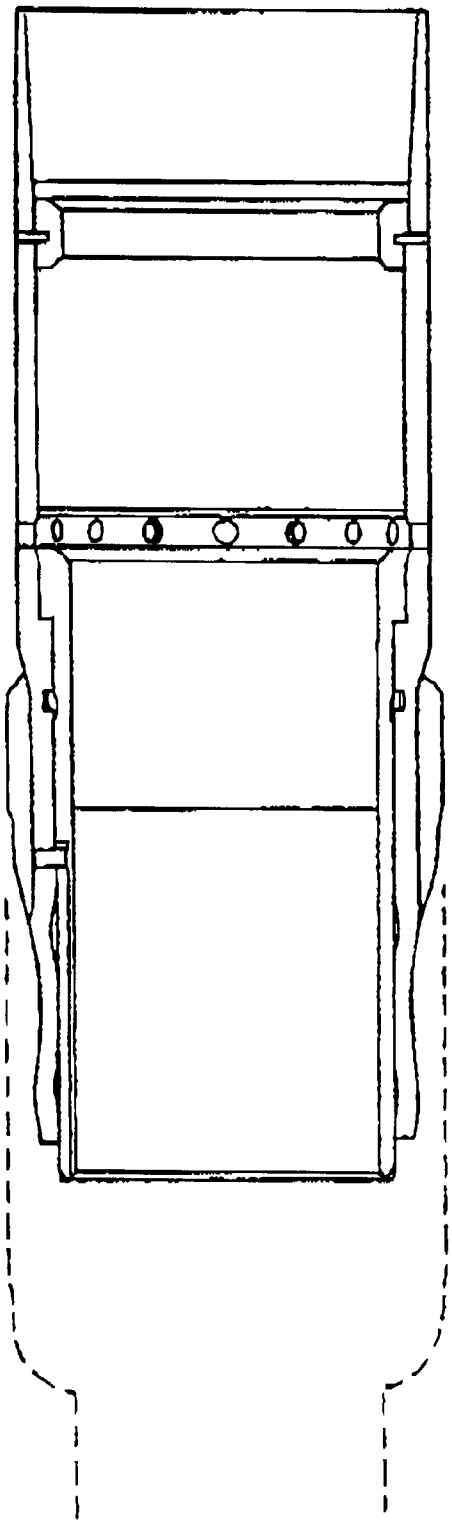

Cementing of the casing may then be undertaken and after the cement has set hard, drilling the next of hole section may commence. This would typically involve passing a drill bit of appropriate diameter through the centre of the casing string and performing a drilling out operation of the inner section 4. As the inner section is made of a readily drillable material, such as aluminium, this does not present any of the difficulties encountered in the past. In FIG. 5, the tool is shown after the drilling-out operation has been completed, it is clear from this view that the bit (which is not shown)is only required to progress through components that were constructed from drillable materials.

By the use of this tool it has been shown that a significant advantage can be obtained and that major cost savings can be released. In particular, the present invention negates the requirement of having to retrieve the drill string and drill bit before cementing the casing. The invention further negates or at least mitigates any requirement for milling. Importantly, the tool incorporates a mechanism which when activated allows the tool to be drilled through with a conventional oilfield drill bit without causing damage to said bit.

It should be appreciated herein that the described and illustrated apparatus and method is only one of many possible techniques. Further modifications and improvements may be incorporated without departing from the scope of the invention herein intended.

What is claimed is:

1. A casing drilling shoe adapted for attachment to a casing string, wherein the shoe comprises an outer drilling section constructed of a relatively hard material and an inner section constructed of a readily drillable material, and wherein means is provided for controllably displacing the outer drilling section to enable the shoe to be drilled through using a standard drill bit and subsequently penetrated by a reduced diameter casing string or liner.

2. A drilling shoe as claimed in claim 1, wherein the outer section is made of steel and the inner section may is made of aluminium.

3. A drilling shoe as claimed in claim 1 or claim 2, wherein the outer section is provided with one or more blades, wherein the blades are moveable from a first or drilling position to a second or displaced position.

4. A drilling shoe as claimed in claim 3, wherein when the blades are in the first or drilling position they extend in a lateral or radial direction to such extent as to allow for drilling to be performed over the full face of the shoe.

5. A drilling shoe as claimed in claim 4, wherein the displacing means for displacing the outer drilling section comprises a thrust means for imparting a downward thrust on the inner section sufficient to cause the inner section to move in down-hole direction relative to the outer drilling section.

6. A drilling shoe as claimed in claim 5, where the displacing means includes an obturating member for obstructing the flow of drilling mud so as to enable increased pressure to be obtained above the inner section, the pressure being adapted to impart a downward thrust.

7. A drilling shoe as claimed in claim 6, wherein the path of displacement of the outer drilling section has a radial component.

8. A casing drilling shoe adapted for attachment to a casing string, wherein the shoe comprises an outer drilling section constructed of a relatively hard material and an inner section constructed of a readily drillable material, and wherein means is provided for controllably displacing the outer drilling section to a position whereby it does not interfere with subsequent drilling through the shoe for the placement of further casing or a liner down-hole.

* * * * *